US010501962B2

(12) United States Patent
Murphy et al.

(10) Patent No.: US 10,501,962 B2
(45) Date of Patent: Dec. 10, 2019

(54) PRIVACY LOCK MECHANISM

(71) Applicant: Schlage Lock Company LLC, Carmel, IN (US)

(72) Inventors: Nathanael S. Murphy, Colorado Springs, CO (US); Peter Malenkovic, Monument, CO (US)

(73) Assignee: Schlage Lock Company LLC, Carmel, IN (US)

( * ) Notice: Subject to any disclaimer, the term of this patent is extended or adjusted under 35 U.S.C. 154(b) by 233 days.

(21) Appl. No.: 15/466,179

(22) Filed: Mar. 22, 2017

(65) Prior Publication Data

US 2017/0275914 A1 Sep. 28, 2017

Related U.S. Application Data

(60) Provisional application No. 62/312,206, filed on Mar. 23, 2016, provisional application No. 62/311,996, filed on Mar. 23, 2016.

(51) Int. Cl.
*E05B 13/00* (2006.01)
*E05B 55/00* (2006.01)
(Continued)

(52) U.S. Cl.
CPC ..... *E05B 13/004* (2013.01); *E05B 55/005* (2013.01); *E05B 63/0056* (2013.01);
(Continued)

(58) Field of Classification Search
CPC .. E05B 13/004; E05B 55/005; E05B 63/0056; E05B 63/0065; E05B 63/0069;
(Continued)

(56) References Cited

U.S. PATENT DOCUMENTS 2,499,948 A 3/1950 Egor
2,778,665 A 1/1957 Young et al.
(Continued)

FOREIGN PATENT DOCUMENTS

EP 1717389 A1 11/2006

OTHER PUBLICATIONS

International Search Report; International Searching Authority; International Patent Application No. PCT/US2017/023805; dated Jun. 15, 2017; 2 pages.
(Continued)

*Primary Examiner* — Nathan Cumar
(74) *Attorney, Agent, or Firm* — Taft Stettinius & Hollister LLP

(57) ABSTRACT

A lock device that prevents operation of at least one chassis spindle from retracting a latch bolt, and which may provide auto-unlock features. Locking of the lock device can effectuate linear displacement of a slider body from an unlocked position to a locked position. Linear displacement of the slider body is translated into rotational displacement of a cam body that includes, or is coupled to, a locking shaft having a cam protrusion, thereby rotating the cam protrusion. As the cam protrusion rotates, the cam protrusion lifts a locking lug to a locked position wherein the locking lug prevents rotational displacement of a first chassis spindle. When in the locked position, a slider arm of the slider body can be positioned in a retention slot. Subsequent rotatable displacement of a second chassis spindle can effectuate displacement of the slider arm from the retention slot and facilitate unlocking of the lock device.

21 Claims, 10 Drawing Sheets

(51) Int. Cl.
*E05B 63/00* (2006.01)
*E05C 1/16* (2006.01)

(52) U.S. Cl.
CPC ..... *E05B 63/0065* (2013.01); *E05B 63/0069* (2013.01); *E05C 1/163* (2013.01)

(58) Field of Classification Search
CPC ..... E05B 13/002; E05B 55/00; E05B 63/006; E05B 13/10; E05B 47/0657; E05B 65/1086; E05B 9/105; E05C 1/163; E05C 1/16
USPC ..... 292/336.3
See application file for complete search history.

(56) References Cited

U.S. PATENT DOCUMENTS 4,142,748 A 3/1979 Hook
4,900,073 A * 2/1990 Doolan ..... E05B 63/16 292/169.22
5,083,823 A 1/1992 Fann et al.
5,286,074 A 2/1994 Lin
5,433,497 A 7/1995 Koenig
5,505,508 A 4/1996 Kuo
5,562,317 A 10/1996 Kuo et al.
5,598,726 A 2/1997 Cordle
5,636,882 A * 6/1997 Hook ..... E05B 3/065 292/169.15
5,816,066 A 10/1998 Russell, IV
5,826,924 A 10/1998 Huang
6,141,998 A * 11/2000 Seo ..... E05B 1/0092 70/224
6,264,255 B1 7/2001 Fortune
6,540,274 B2 4/2003 Bates et al.
6,644,077 B1 * 11/2003 Huang ..... E05B 13/004 292/358
6,705,138 B1 * 3/2004 Shen ..... E05B 55/06 292/336.3
6,802,546 B2 10/2004 Bates et al.
7,387,005 B2 6/2008 Huang et al.
8,505,345 B2 8/2013 Sun et al.
2002/0117866 A1 * 8/2002 Bates ..... E05C 1/163 292/336.5
2005/0046203 A1 3/2005 Huang
2012/0267903 A1 * 10/2012 Welsby ..... E05B 55/005 292/145
2013/0269402 A1 * 10/2013 Vasudevan ..... E05B 55/005 70/156

OTHER PUBLICATIONS

International Written Opinion; International Searching Authority; International Patent Application No. PCT/US2017/023805; dated Jun. 15, 2017; 6 pages.
Australian Examination Report; Australia Patent Office; Australian Patent Application No. 2017238506; dated May 16, 2019; 2 pages.
New Zealand Office Action, New Zealand Intellectual Property Office, New Zealand Patent Application No. 746963, dated Mar. 20, 2019, 2 pages.
Canadian Office Action; Canadian Intellectual Property Office; Canadian Patent Application No. 3,018,762; dated Jul. 12, 2019; 4 pages.

* cited by examiner

PRIVACY LOCK MECHANISM

CROSS-REFERENCE TO RELATED APPLICATIONS

The present application claims the benefit of U.S. Provisional Patent Application No. 62/312,206 filed Mar. 23, 2016, and also claims the benefit of U.S. Provisional Patent Application No. 62/311,996 filed Mar. 23, 2016, the contents of each application incorporated herein by reference in their entirety.

TECHNICAL FIELD

Embodiments of the present application generally relate to locking mechanisms, and more particularly, but not exclusively, to locking mechanisms for privacy door locks.

BACKGROUND

Mechanical tubular lock devices may be utilized for a variety of different types of applications. For example, certain tubular lock devices may selectively control the ability to displace an entryway device, to which the lock device may be mounted or otherwise operably coupled, including, but not limited to, the displacement of a door or gate, relative to an entryway. Moreover, such lock devices may be used in connection with the entryway device to at least attempt to selectively control the ingress/egress through the entryway.

Certain types of mechanical tubular lock devices, such as, for example, privacy door locks, are constructed for operation of the lock device from one side of the lock device. For example, certain privacy lock devices are constructed such that, when operably mounted or coupled to an entryway device, typical control of the lock device being in a locked position or state and an unlocked position or state generally occurs on one side of the lock device, such as, for example, from one of an inside or outside position relative to the lock device, entryway device, and/or entryway. Accordingly, with the possible exception of an emergency release that is often of limited accessibility or the use of illicit means, operation of the lock device from the opposite side of the lock device generally does not include the ability to displace the lock mechanism between the locked and unlocked positions.

Often, privacy lock devices include opposing knobs or levers that are positioned, relative to the entryway device, entryway, and/or associated structure, such that one knob or lever can be considered an inside knob or lever, and the other an outside knob or lever. In such situations, the inside knob or lever often, although not necessarily, is structured to control the ability to selectively lock and unlock the lock device. According to at least certain designs, the outside knob or lever is locked indirectly through a chassis assembly of the tubular lock device. Yet, with such designs, torque exerted on the outside knob or lever is typically transmitted to a relatively weak central spindle, which may damage and/or break the lock device. Further, attempts to resist or prevent such torque from damaging or breaking the lock device often involves increasing the number of parts of the lock device, or increasing the strength of certain components by means of a higher strength raw material or incorporating heat treatment, which can increase the complexity and costs of the lock device. Moreover, such corrective measures can cause the lock device to be affected by door thickness, which can in turn adversely impact the ease with which the lock device may be installed on, or to, an entryway device.

BRIEF SUMMARY

One aspect of the present application is directed to an apparatus for a lock device that includes a first locking module having a locking shaft and a locking lug. The locking shaft can include a first end, a second end, and a cam protrusion, the cam protrusion outwardly extending at the first end of the locking shaft. The apparatus further includes a second locking module having a cam body and a slider body, the cam body having at least one helical groove having a first wall and a second, opposing wall. At least a portion of the slider body slidingly engages the first wall of at least one of the at least one helical groove as the slider body is linearly displaced from a first position to a second position to rotate the cam body in a first rotational direction and effectuate rotational displacement of the cam protrusion in the first rotational direction. Further, the cam protrusion linearly displaces the locking lug in a first direction to a locked position as the cam protrusion rotates in the first rotational direction. Additionally, at least a portion of the slider body slidingly engages the second wall of at least one of the at least one helical groove as the slider body is linearly displaced from the second position to the second first position to rotate the cam body in a second rotational direction and effectuate rotational displacement of the cam protrusion in the second rotational direction. The locking lug is displaceable in a second direction to an unlocked position as the cam protrusion rotates in the second rotational direction, the second rotational direction being opposite of the first rotational direction. Further, the second directions in which the locking lug is linearly displaced are opposite directions. Additionally, the linear displacement of the slider body between the first and second positions are in directions that are generally perpendicular to the first and second directions of linear displacement of the locking lug.

Another aspect of the present application is directed to a lock assembly that includes a first latch assembly portion having a first lever, a first chassis portion, and a first locking module portion. The first locking module portion has a locking shaft and a locking lug, the locking shaft having a cam protrusion, the slider body having a slider arm, the first chassis portion including a locking slot sized to receive selective insertion of at least a portion of the locking lug. The lock assembly further includes a second latch assembly portion having a second lever, a second chassis portion, and a second locking module portion. The second locking module has a cam body and a slider body, the slider body having a slider arm. The second chassis portion can include a retention slot sized to receive selective insertion of at least a portion of the slider arm. Further, the cam body is rotatably displaceable in a first rotational direction to effectuate rotational displacement of the cam protrusion in the first rotational direction when the slider body is linearly displaced from a slider unlocked position to a slider locked position. The rotational displacement of the cam protrusion in the first rotational direction linearly displaces the locking lug from a lug unlocked position to a lug locked position, at least a portion of the locking lug extending into the locking slot of the first chassis portion when in the lug locked position. The locking lug can be sized to prevent rotational displacement of the first chassis portion when in the lug locked position. Further, at least a portion of the slider arm of the slider body extends into the retention slot in the second chassis portion when the slider body is in the slider locked position. The slider arm can be sized to prevent rotational displacement of the second chassis portion when in the retention slot. The cam body is rotatably displaceable in a second rotational direction to effectuate rotational displacement of the cam protrusion in the second rotational direction when the slider body is linearly displaced from the slider locked position to the slider unlocked position. Further, the cam protrusion can be disengaged from retaining the locking lug in the lug locked position by displacement of the cam body in the second rotational direction.

BRIEF DESCRIPTION OF THE DRAWINGS

The description herein makes reference to the accompanying figures wherein like reference numerals refer to like parts throughout the several views.

Figure 1:
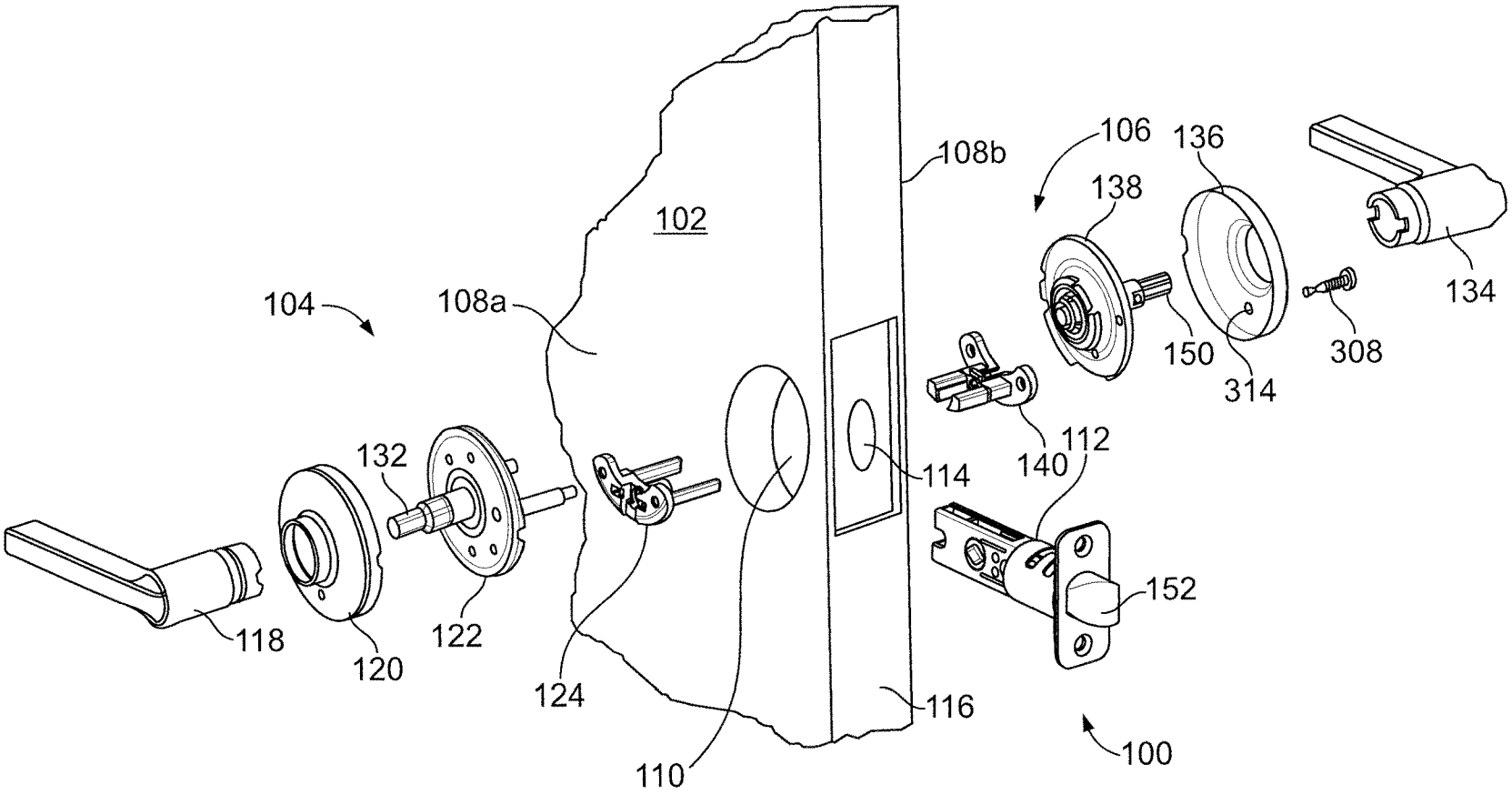
FIG. 1 illustrates an exploded view of a lock assembly that is structured to be operably mounted or coupled to an entryway device.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates an exploded view of a lock assembly 100 that is structured to be operably mounted or coupled to an entryway device 102, such as, for example, a door or gate, among other devices. The lock assembly 100 includes a first latch assembly portion 104 that is structured to extend from a first side 108*a* of the entryway device 102, and a second latch assembly portion 106 that is structured to extend from the second side 108*b* of the entryway device 102. The first side 108*a* may alternatively be referred to as the exterior or unsecured side, and the second side 108*b* may alternatively be referred to as the interior or secured side. Similarly, the first latch assembly portion 104 and components thereof may be referred to herein as exterior or outside components, and the second latch assembly portion 106 and components thereof may be referred to herein as interior or inside components.

At least a portion of the first and second latch assembly portions 104, 106 may extend into a cross-bore 110 in the entryway device 102 that extends along a thickness of at least a portion of the entryway device 102 and between the opposite first and second sides 108*a*, 108*b* of the entryway device 102. The first and second latch assembly portions 104, 106 may also be coupled to a latch assembly 112 that extends into an edge bore 114 on a side edge 116 of the entryway device 102 that is generally perpendicular to and in communication with the cross-bore 110 in the entryway device 102.

Figure 12:
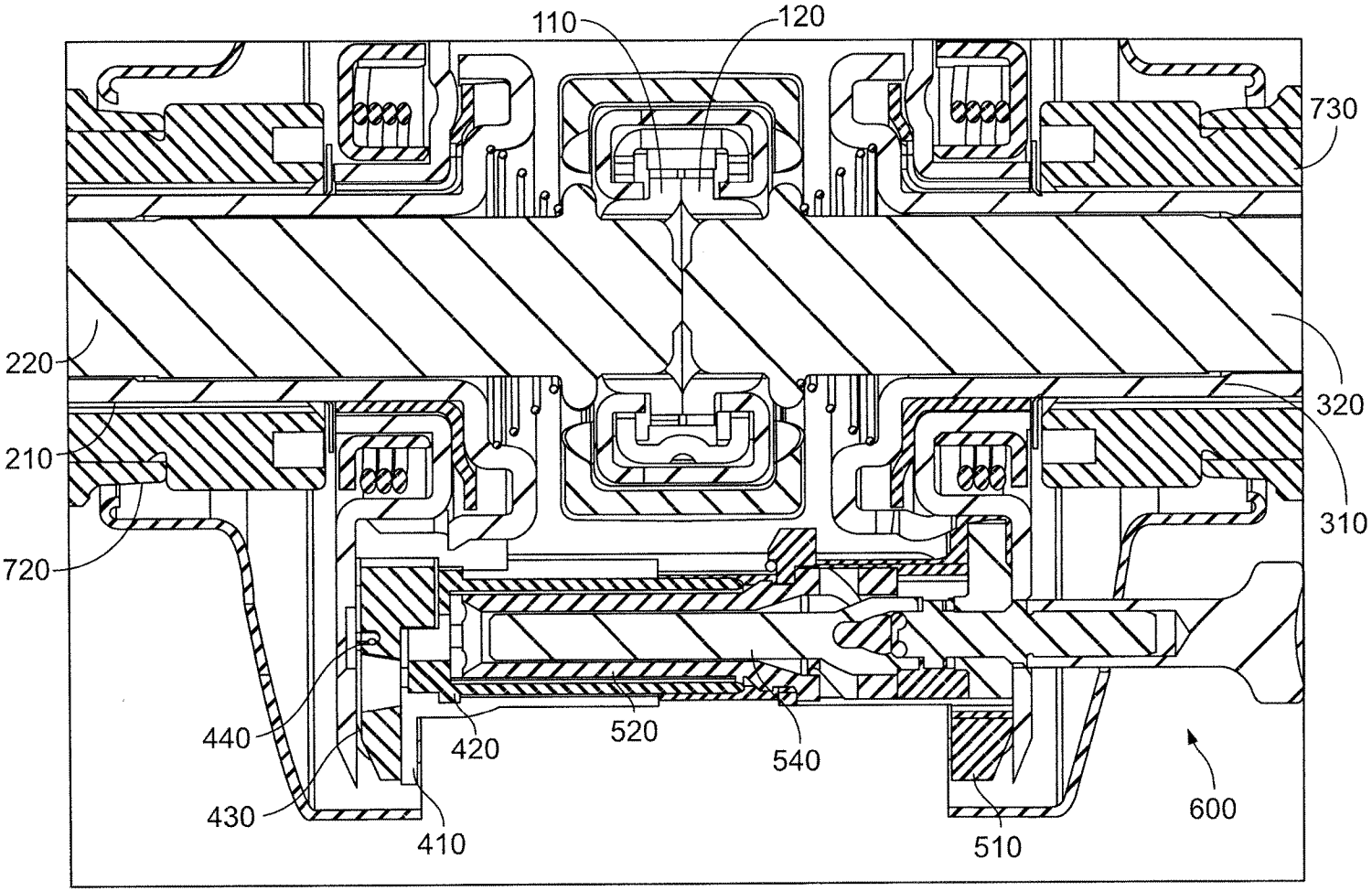
FIG. 12 illustrates a cross sectional view of an exemplary lock assembly in an unlocked position or state.
Figure 13:
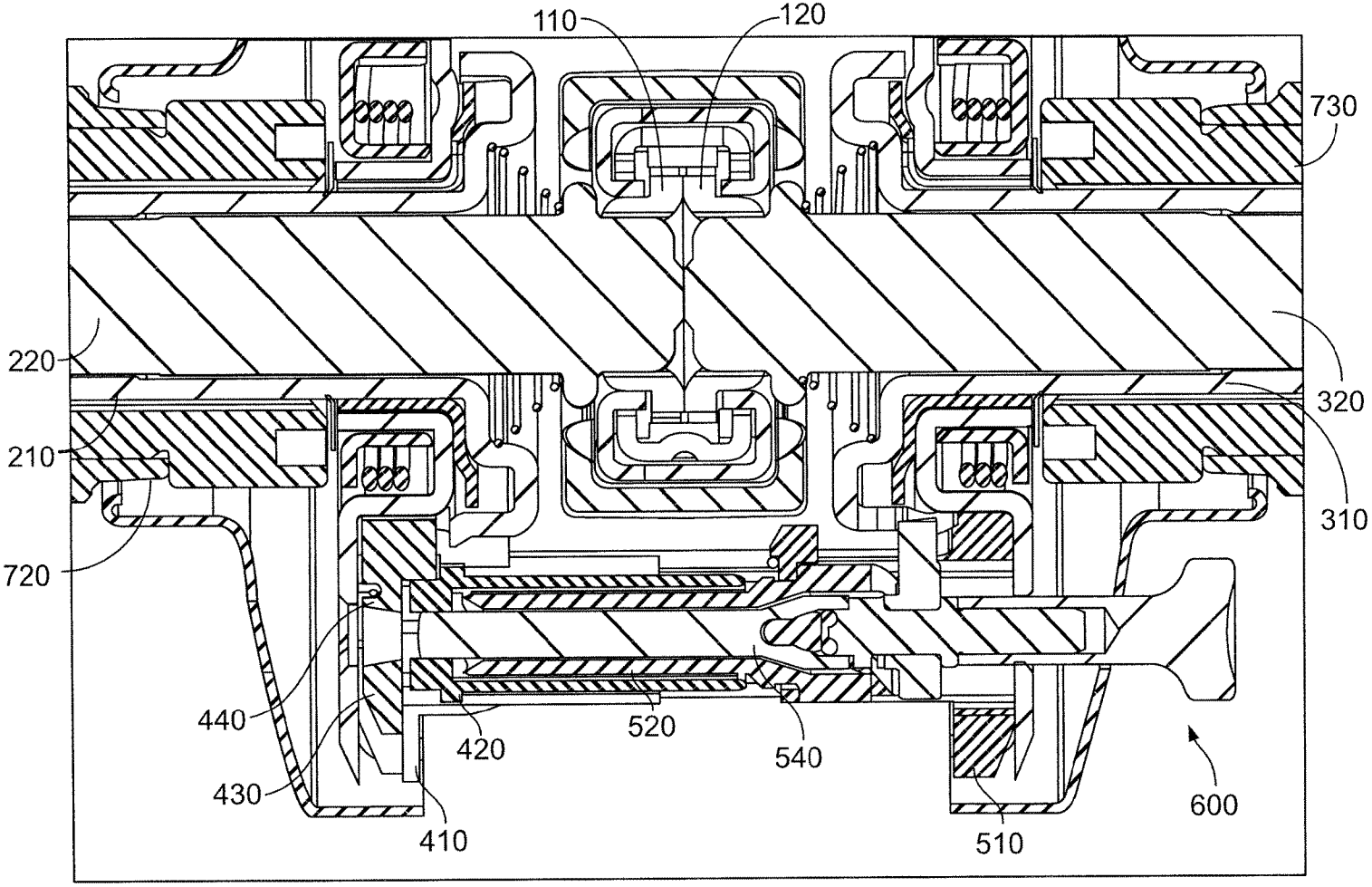
FIG. 13 illustrates a cross sectional view of the exemplary lock assembly depicted in FIG. 12 in a locked position or state.

According to certain embodiments, the first latch assembly portion 104 may include a first lever 118, a first rose 120, a first chassis portion 122, and a first locking module portion 124 of a locking module 126 (FIGS. 12 and 13). Although the first locking module portion 124 is illustrated as a separate subassembly from the first chassis portion 122, according to certain embodiments, the first locking module portion 124 may be integrated into the first chassis portion 122. The first rose 120 may be sized to extend over at least a portion of the first chassis portion 122 so that the first rose 120 can be positioned to at least assist in covering or concealing the first chassis portion 122 from view at least when the lock assembly 100 is operably mounted or coupled to the entryway device 102. In certain embodiments, the first rose 120 can provide a decorative plate or cover that may enhance the aesthetics of the lock assembly 100.

According to certain embodiments, the first chassis portion 122 includes a first chassis spindle 128 that extends through at least a portion of a first spring cage assembly 130. The first chassis spindle 128 is sized for engagement with at least a first drive spindle 132 to rotationally couple therewith. For example, according to certain embodiments, at least a portion of the first chassis spindle 128 may receive insertion of the first drive spindle 132 such that rotational displacement of the first chassis spindle 128 is translated into rotational displacement of at least the first drive spindle 132. The first chassis spindle 128 may be rotationally coupled with the first drive spindle 132 via mating portions having non-circular shapes and/or a mechanical fastener, such as a pin, screw, or key. The first drive spindle 132 may also be coupled to the first lever 118, such as, for example, via engagement with a mating recess in the first lever 118. According to such embodiments, the first drive spindle 132 may be coupled to the first lever 118 and extend into at least the first chassis spindle 128 such that rotational or pivotal displacement of the first lever 118 is translated by the first drive spindle 132 into rotational displacement of the first chassis spindle 128.

Similarly, the second latch assembly portion 106 can include a second lever 134, a second rose 136, a second chassis portion 138, and a second locking module portion 140. Although the second locking module portion 140 is illustrated as a separate subassembly from the second chassis portion 138, according to certain embodiments, the second locking module portion 140 may be integrated into the second chassis portion 138. The second rose 136 may be sized to extend over at least a portion of the second chassis portion 138 so that the second rose 136 can be positioned to at least assist in covering or concealing the second chassis portion 138 from view at least when the lock assembly 100 is operably mounted or coupled to the entryway device 102. In certain embodiments, the second rose 136 can provide a decorative plate or cover that may enhance the aesthetics of the lock assembly 100.

According to certain embodiments, the second chassis portion 138 includes a second chassis spindle 142 that extends through at least a portion of a second spring cage assembly 144. The second chassis spindle 142 is sized for engagement with at least a second drive spindle 150 to rotationally couple therewith. For example, according to certain embodiments, at least a portion of the second chassis spindle 142 may receive insertion of the second drive spindle 150 such that rotational displacement of the second chassis spindle 142 is translated into rotational displacement of at least the second drive spindle 150. The second chassis spindle 142 may be rotationally coupled with the second drive spindle 150 via mating portions having non-circular shapes and/or a mechanical fastener, such as a pin, screw, or key. The second drive spindle 150 may also be coupled to the second lever 134, such as, for example, via engagement with a mating recess in the second lever 134. According to such embodiments, the second drive spindle 150 may be coupled to the second lever 134 and extend into at least the second chassis spindle 142 such that rotational or pivotal displacement of the second lever 134 is translated by the second drive spindle 150 into rotational displacement of the second chassis spindle 142.

According to the illustrated embodiment, at least a portion of the first and second chassis portions 122, 138 can extend into the cross-bore 110 in the entryway device 102, including portions of the first and second chassis portions 122, 138 that can engage the latch assembly 112. Moreover, the first and second chassis portions 122, 138 may each be operably coupled to the latch assembly 112 such that rotation of the first or second chassis spindles 128, 142 is translated into linear displacement of a latch bolt 152 of the latch assembly 112 between an extended position and a retracted position.

Figure 3:
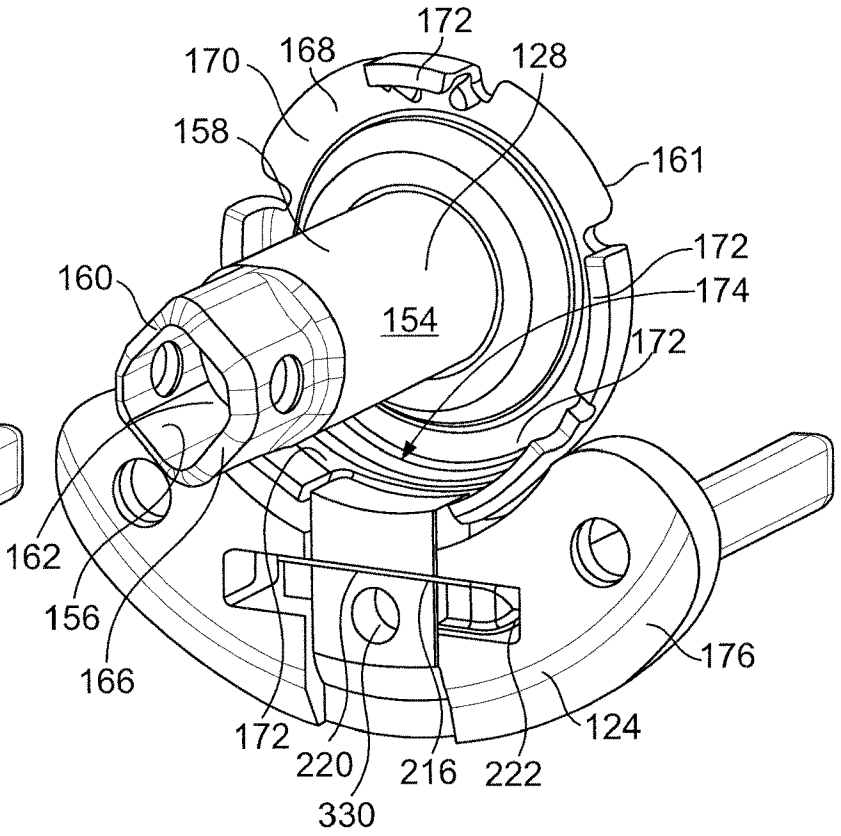
FIG. 3 illustrates a front side perspective view of exemplary embodiment of the first chassis spindle and the first locking module portion depicted in FIG. 2 in a locked, engaged position or state.
Figure 2:
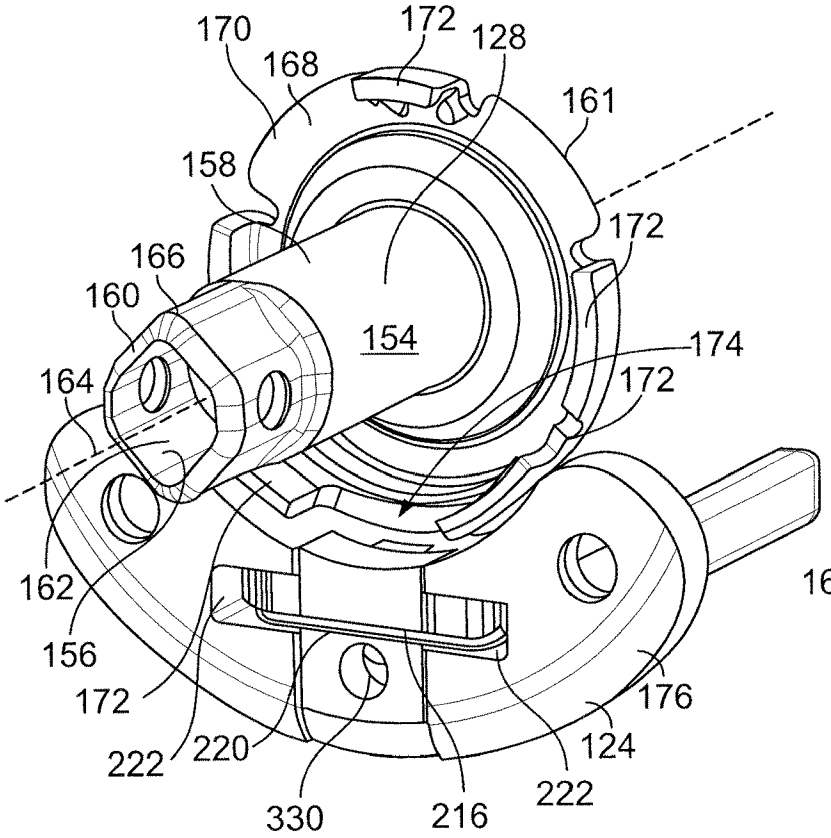
FIG. 2 illustrates a front side perspective view of exemplary embodiment of a first chassis spindle and a first locking module portion of a lock device in an unlocked, disengaged position or state.

With additional reference to FIGS. 2 and 3, illustrated therein are front side perspective views of an exemplary embodiment of the first chassis spindle 128 and the first locking module portion 124. More specifically, FIG. 2 illustrates the first chassis spindle 128 and the first locking module portion 124 in an unlocked, disengaged state, and FIG. 3 illustrates the first chassis spindle 128 and the first locking module portion 124 in a locked, engaged state. As shown, the first chassis spindle 128 includes a first wall 154 having an inner surface 156, an outer surface 158, a first end 160, and a second end 161. The inner surface 156 generally defines a first aperture 162 that extends along a first central axis 164, and which is sized to receive passage of at least a portion of the first drive spindle 132. Further, as shown, according to certain embodiments, at least a first engagement portion 166 of the inner surface 156 of the first wall 154 is sized for engagement with the first drive spindle 132 such that rotational displacement of the first drive spindle 132 is translated into rotational displacement of at least the first chassis spindle 128. The first engagement portion 166 may have a variety of different shapes and sizes, such as, for example, having a non-circular cross-sectional shape that mates a corresponding non-round portion of the first drive spindle 132. Additionally, according to certain embodiments, the first engagement portion 166 may be at, and/or extend along, a variety of locations along the first wall 154, including, for example, at and/or around the first end 160 of the first wall 154.

The second end 161 of the first wall 154 may be adjacent to a first plate portion 168 of the first chassis spindle 128. According to the illustrated embodiment, a base wall 170 of the first plate portion 168 of the first chassis spindle 128 radially outwardly extends from the first wall 154 and is generally perpendicular to the first central axis 164. An outer periphery of the base wall 170 of the first plate portion 168 can include one or more first extensions 172 that extend from the base wall 170 in a direction that is generally parallel to the first central axis 164. Further, according to certain embodiments, a locking slot 174 defines a gap that separates two adjacent first extensions 172 or two portions of a single first extension 172, as discussed below.

Figure 4:
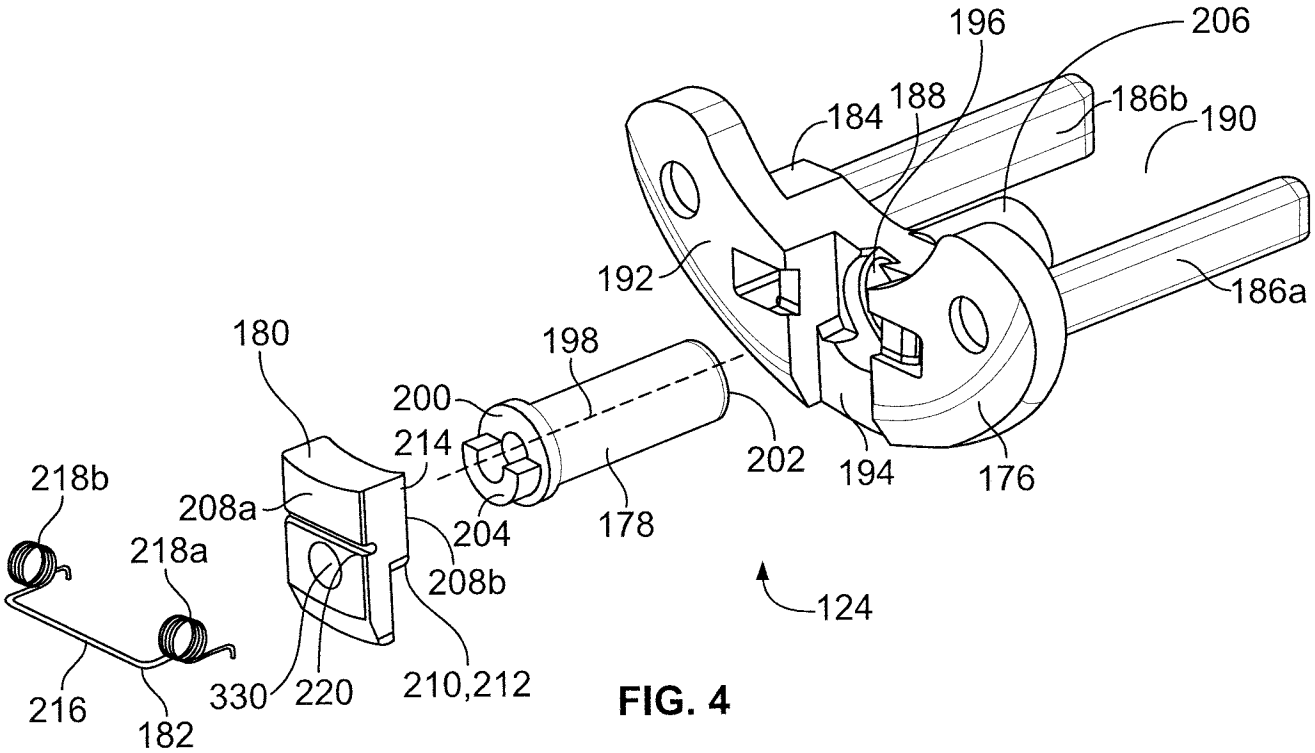
FIG. 4 illustrates an exploded side perspective view of an exemplary first locking module portion.

FIG. 4 illustrates an exploded side perspective view of an exemplary first locking module portion 124. As shown, according to certain embodiments, the first locking module portion 124 can include a first housing 176, a locking shaft 178, a locking lug 180, and a lug biasing element 182. The first housing 176 can provide a support structure for the first locking module portion 124. Further, the first housing 176 can include a first body portion 184 and a pair of first leg extensions **186*a*, 186*b*, which extend from a rear side 188 of the first body portion 184 and are separated from each other by a space 190. Additionally, a front side 192 of the first body portion 184 may include a lug aperture 194 that is sized to accommodate at least linear displacement of a locking lug 180 of the first locking module portion 124**, as described in further detail below.

The first housing 176 may further include a first housing aperture 196 that extends through at least a portion of the first body portion 184, and which is sized to accommodate placement of at least a portion of the locking shaft 178, the locking shaft 178 being rotatably displaceable within the first housing aperture 196 about a locking shaft axis 198. Further, the locking shaft axis 198 may be generally parallel to, and offset from, the first central axis 164. The locking shaft 178 includes a first end 200 and a second end 202, the first end 200 including a cam protrusion 204 that extends outwardly from the first end 200 of the locking shaft 178.

Further, according to the exemplary embodiment, the cam protrusion 204 may be sized to extend into at least a portion of the lug aperture 194.

The cam protrusion 204 can have a variety of shapes and configurations. For example, according to the exemplary embodiment, the cam protrusion 204 is semi-circular or semi-annular in shape. Moreover, according to the depicted embodiment, the cam protrusion 204 has a semi "U" shape. However, it is also contemplated that the cam protrusion 204 may have any of a variety of other shapes and configurations. Additionally, according to certain embodiments, at least a portion of the locking shaft 178 in the vicinity of the second end 202 of the locking shaft 178 may extend into a hub 206 that extends from the rear side 188 of the first body portion 184 and occupy a portion of the space 190 between the first leg extensions 186*a*, 186*b*. Further, according to certain embodiments, the hub 206 may be positioned such that a gap or portion of a space 190 is presented on each side of the hub 206, and separates the hub 206 from the first leg extensions 186*a*, 186*b*.

According to the depicted embodiment, the locking shaft 178 serves as the motion input to the first locking module portion 124. Further, according to certain embodiments, displacement of the locking shaft 178 can generally be relatively constrained to rotation about the locking shaft axis 198 of the first locking module portion 124. Further, according to the depicted embodiment, the locking shaft 178 can rotate between a first unlocked position and a second locked position, as discussed below.

Figure 6:
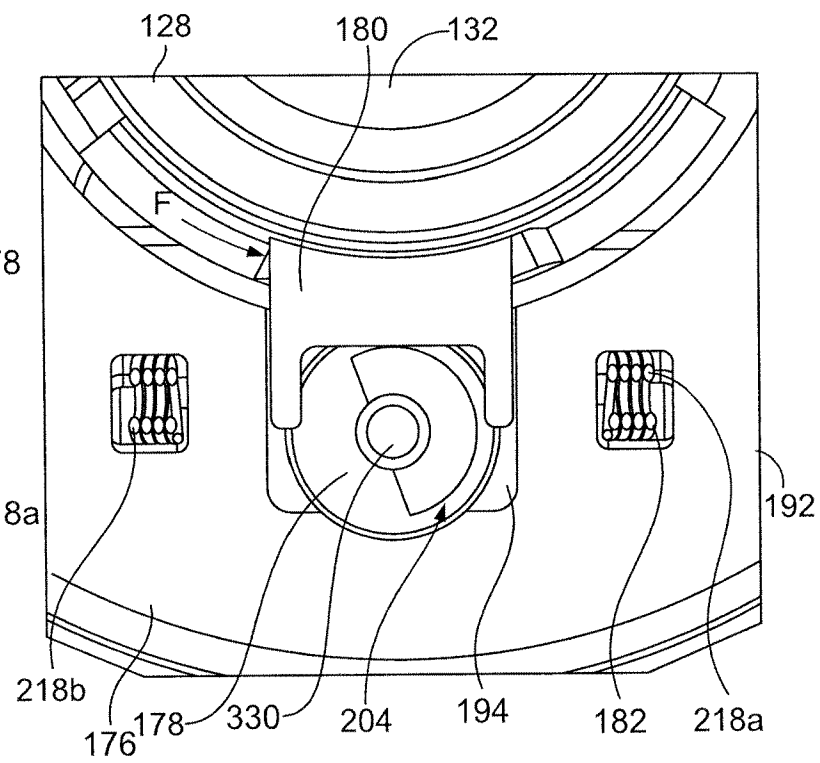
FIG. 6 illustrates a front view of the cam protrusion of the locking shaft depicted in FIG. 5 in a locked second position and the locking lug in an extended second position.
Figure 5:
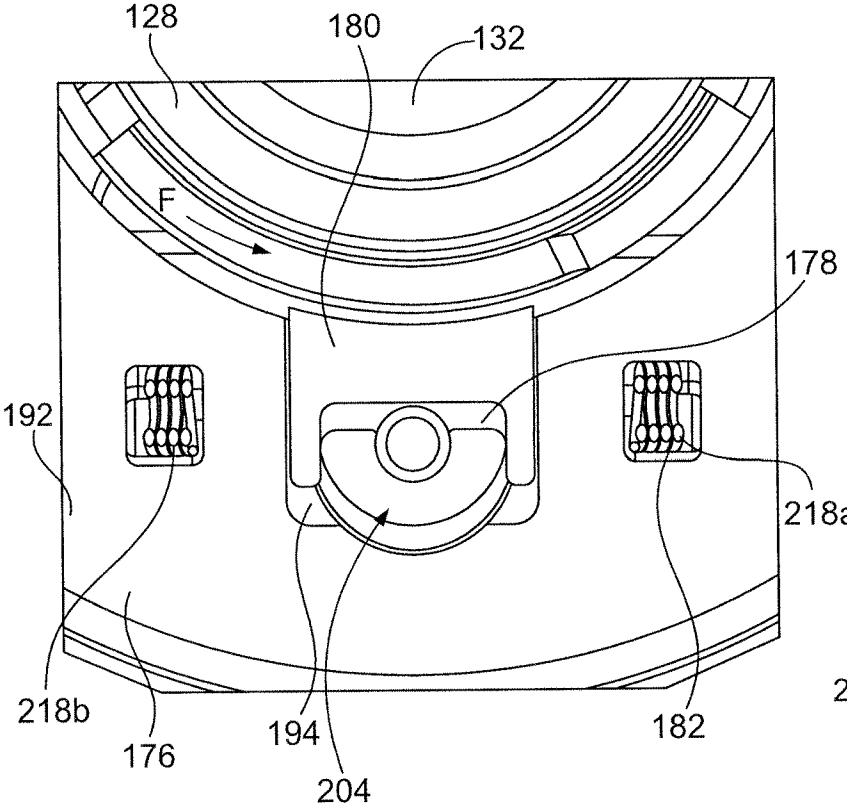
FIG. 5 illustrates a front view of a cam protrusion of an exemplary locking shaft in a unlocked first position and an exemplary locking lug in a retracted first position.

With reference to FIGS. 4-6, the locking lug 180 is structured to selectively block rotation of the first chassis spindle 128. According to the depicted embodiment, the locking lug 180 includes opposite first and second sides 208*a*, 208*b*. The second side 208*b* includes an engagement surface or member 210 that is adapted for selective engagement with the cam protrusion 204 of the locking shaft 178. The engagement member 210 may have a variety of different shapes and/or configurations, including, for example being a protrusion that, at least relative to other portions of the second side 208*b*, extends away from a second side 208*b* in a manner that may accommodate selective engagement with the cam protrusion 204. According to the illustrated embodiment, the engagement member 210 is a surface 212 formed by a protrusion 214, or conversely, a recess, that outwardly or inwardly extends/recesses a portion of the second side 208*b*.

As illustrated in FIG. 5, when the locking shaft 178 is at the unlocked first position, the cam protrusion 204 may be disengaged with the engagement member 210, such that the locking lug 180 is at a recessed first position, as illustrated in FIG. 2. According to the illustrated embodiment, when the locking lug 180 is in the first position, the locking lug 180 is at least partially positioned in the locking slot 174 such that the locking lug 180 is at a location relative to at least the a first chassis spindle 128 that the locking lug 180 does not impede or otherwise interfere with rotational displacement of the first chassis spindle 128. For example, according to the depicted embodiment, when in the retracted first position, the locking lug 180 does not extend into the locking slot 174 of the first chassis spindle 128.

As illustrated in FIG. 6, when the locking shaft 178 is rotatably displaced to a locked second position, the cam protrusion 204 of the locking shaft 178 may engage the engagement member 210 of the locking lug 180 in a manner that at least generally linearly displaces the locking lug 180 to, and/or binds the locking lug 180 at, an extended second position, as shown in FIG. 3. According to certain embodiments, such linear displacement of the locking lug 180 may be in a direction that is generally perpendicular to the first central axis 164 of the first chassis spindle 128 and/or the locking shaft axis 198 of the locking shaft 178. For example, in embodiments in which the first central axis 164 extends in a horizontal direction, displacement of the locking lug 180 may occur in a vertical direction.

When displaced to the extended second position, the locking lug 180 may be extend into the locking slot 174 of the first chassis spindle 128 such that the locking lug 180 interferes with and/or prevents rotational displacement of at least the first chassis spindle 128. Moreover, by preventing rotational displacement of the first chassis spindle 128 when the locking lug 180 is in the second position, the locking lug 180 may prevent the first chassis spindle 128 from being displaced in a manner that may facilitate the displacement of a latch bolt 152 of the latch assembly 112. Thus, with the locking lug 180 positioned in the locking slot 174 of the first chassis spindle 128, the first chassis spindle 128 may not be rotatably displaced by manipulation of the first lever 118, thereby at least preventing the displacement of a latch bolt 152 of the latch assembly 112 from the extended position, which may prevent displacement of the associated entryway device 102 away from a closed position relative to the associated entryway.

The lug biasing element 182 of the first locking module portion 124 may be structured to bias the locking lug 180 toward the retracted first position. Thus, according to such an embodiment, as the locking shaft 178 is rotatably displaced from the locked second position (FIG. 6) to the unlocked first position (FIG. 5), the cam protrusion 204 may disengage from the engagement member 210 of the locking lug 180, or otherwise be positioned, such that the cam protrusion 204 does not prevent the locking lug 180 from being generally linearly displaced from the extended second position, to the retracted first position. According to such an embodiment, the lug biasing element 182 may exert a force on the locking lug 180 that at least assists in the linear displacement of the locking lug 180 out from the locking slot 174 and to the retracted first position.

A variety of different types of biasing elements can be employed for the lug biasing element 182, including, but not limited to, a return spring. As shown in at least FIGS. 2-4, according to the illustrated embodiment, the lug biasing element 182 can include an arm portion 216 that extends between two spring coils 218*a*, 218*b*. In other embodiments, the lug biasing element 182 may be provided in another form, such as a simple torsion spring. The arm portion 216 may engage the locking lug 180 (such as, for example, be positioned in a slot 220 in the first side 208*a* of the locking lug 180) such that the arm portion 216 may exert a force against an adjacent portion of the locking lug 180 that can assist in facilitating the linear displacement of the locking lug 180 to the retracted first position. Further, according to certain embodiments, at least a portion, if not all, of the spring coils 218*a*, 218*b* of the lug biasing element 182 can be recessed in one or more slots 222 in the housing 176.

Referencing at least FIG. 5, according to such an embodiment, the majority of the applied force on the locking lug 180 can be transferred through the locking lug 180 and into the first housing 176 of the first locking module portion 124. Further, any component of that force that is transferred into the locking shaft 178 can be further reduced by frictional forces at the interface between the engagement member 210 of the locking lug 180 and the locking shaft 178, and more specifically, the interface between the locking lug 180 and the cam protrusion 204. According to such an embodiment, the frictional torque that resists rotation of the locking shaft 178 can be relatively low, particularly when compared to other existing lock designs.

Figure 8:
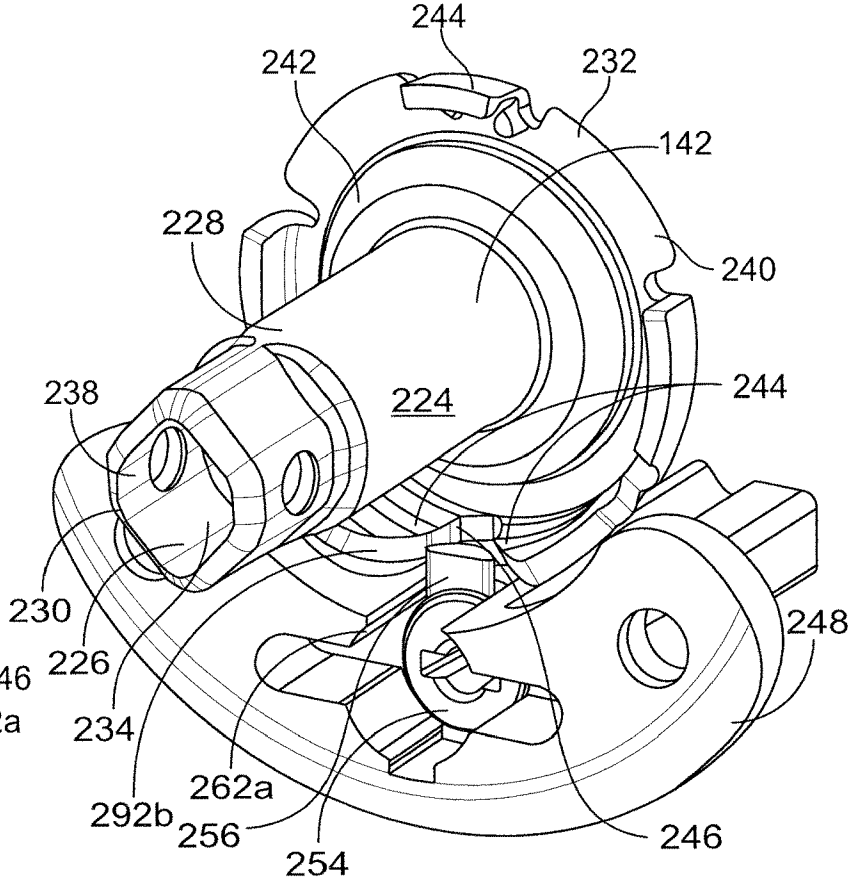
FIG. 8 illustrates a front side perspective view of exemplary embodiment of the second chassis spindle and the second locking module portion depicted in FIG. 7 in a locked, engaged state.
Figure 7:
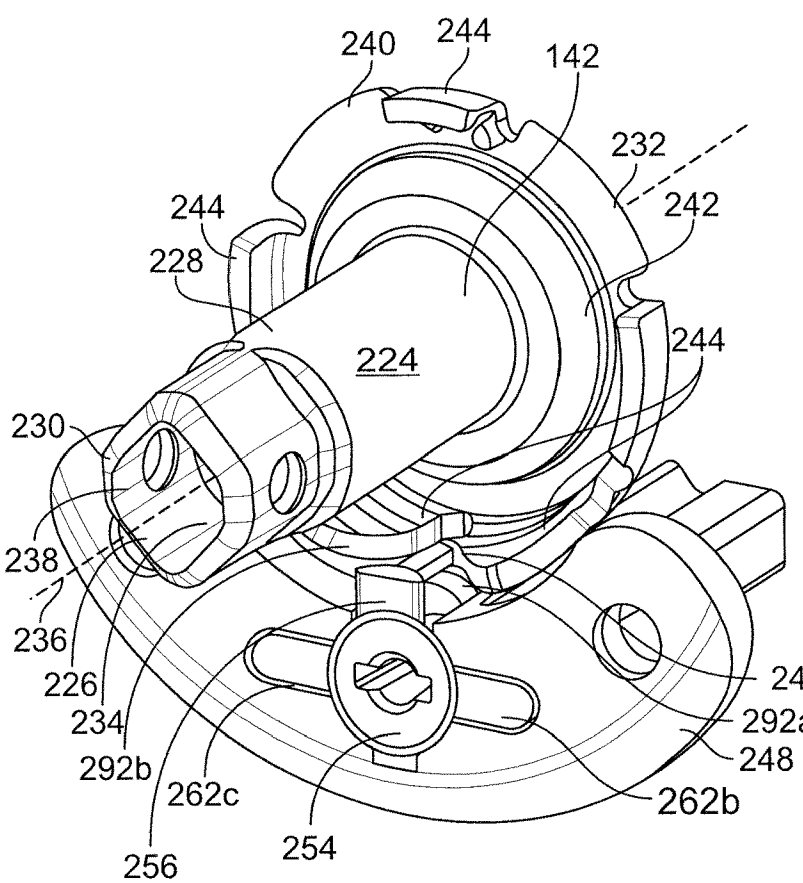
FIG. 7 illustrates a front side perspective view of exemplary embodiment of a second chassis spindle and a second locking module portion in an unlocked, disengaged state.

FIGS. 7 and 8 illustrate front side perspective views of exemplary embodiment of a second chassis spindle 142 and a second locking module portion 140 of the locking module 126. More specifically, FIGS. 7 and 8 respectively illustrated the second chassis spindle 142 and the second locking module portion 140 in a locked, engaged position or state and an unlocked, disengaged position or state. The second chassis spindle 142 includes a second wall 224 having an inner surface 226, an outer surface 228, a first end 230, and a second end 232, the inner surface 226 generally defining a second aperture 234 that extends along a second central axis 236 and which is sized to receive passage of at least a portion of the second drive spindle 150. Further, as shown, according to certain embodiments, at least a second engagement portion 238 of the inner surface 226 of the second wall 224 is sized to engage the second drive spindle 150 such that rotational displacement of the second drive spindle 150 is translated into rotational displacement of at least the second chassis spindle 142. The second engagement portion 238 may have a variety of different shapes and sizes, such as, for example, having a non-circular cross-sectional shape, that mates with a corresponding non-circular portion of the second drive spindle 150. Additionally, according to certain embodiments, the second engagement portion 238 may be at, and/or extend along, a variety of locations along the second wall 224, including, for example, at and/or around the first end 230 of the second wall 224.

The second end 232 of the second wall 224 may be adjacent to a second plate portion 240. According to the illustrated embodiment, a base wall 242 of the second plate portion 240 of the second chassis spindle 142 extends radially outwardly from the second wall 224, and is generally perpendicular to the second central axis 236 of the second aperture 234. An outer periphery of the base wall 242 of the second plate portion 240 can include one or more second extensions 244 that extend from the base wall 242 in a direction that is generally parallel to the second central axis 236. Further, according to certain embodiments, a retention slot 246 defines a gap that separates two adjacent second extensions 244 or two portions of a single second extension 244. As discussed below, the retention slot 246 is sized to accommodate axial displacement of a slider arm 256 of a slider body 254 of the second locking module portion 140.

Figure 9:
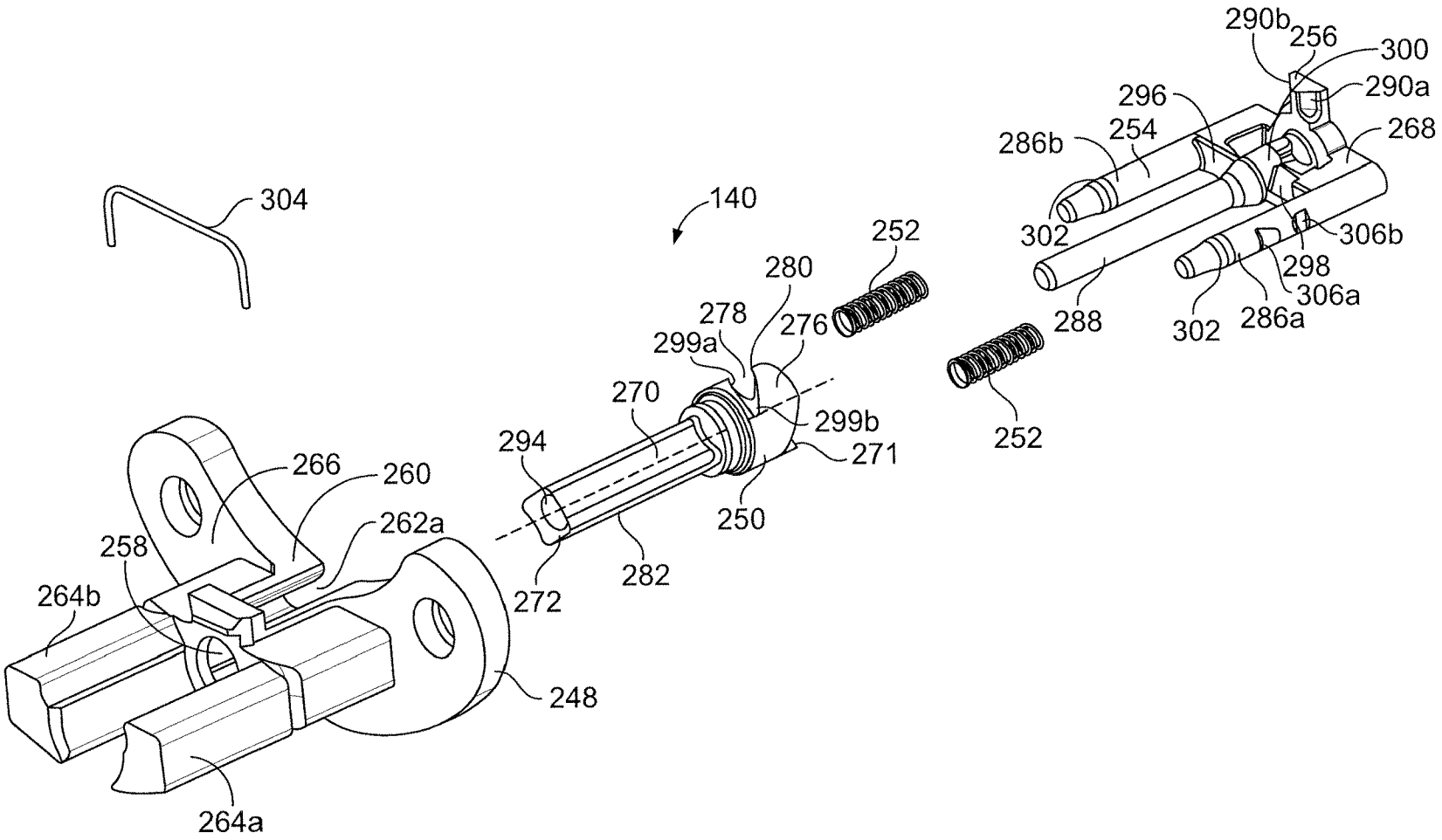
FIG. 9 illustrates an exploded perspective view of the second locking module that is depicted FIGS. 7 and 8.

Referencing FIG. 9, the second locking module portion 140 includes a second housing 248, a cam body 250, at least one slider biasing element 252, and the slider body 254. The second housing 248 may include a second housing aperture 258 that extends through at least a portion of a second body portion 260 of the second housing 248, and which is sized to accommodate placement of at least a portion of the slider body 254 and the cam body 250. Further, according to certain embodiments, the second housing aperture 258 may include a first slot 262*a* that extends through at least a portion of the second housing 248 (such as, for example, an upper surface of the second housing 248) that can accommodate the axial displacement of the slider arm 256. Additionally, as shown by at least FIG. 7, the second housing aperture 258 may include one or more additional slots, including, for example, second and third slots 262*b*, 262*c* that can accommodate slideable displacement of other portions of the slider body 254. One or more second leg extensions 264*a*, 264*b* may extend from a first side 266 of the second housing 248, while a slider housing 268 of the slider body 254 may be inserted through the second housing aperture 258. Further, according to certain embodiments, at least a portion of the second leg extensions 264*a*, 264*b* may be structured to occupy at least a portion of the gap or space 190 between the first leg extensions 186*a*, 186*b* of the first housing 176.

The cam body 250 is adapted to convert linear motion of the slider body 254 into rotary motion about a cam axis 270 of the cam body 250. The cam axis 270 can be generally parallel to, and offset from, the second central axis 236. The cam body 250 includes a first end 272 and a second end 274, the second end 274 including a cam hub 276 that includes one or more outer grooves 278. Further, according to certain embodiments, the one or more outer grooves 278 may have generally helical orientations that extend through at least a portion of the cam hub 276 such that the outer groove 278 is in communication with a shaft aperture 280 of the cam hub 276. Additionally, a cam shaft 282 may extend from the cam hub 276 around a first end 272 of the cam body 250. The cam shaft 282 may be adapted to translate rotational movement to the locking shaft 178. For example, according to certain embodiments, the cam shaft 282 has a non-circular cross-sectional shape that is sized for mating insertion in a locking aperture 284 (FIGS. 12 and 13) that extends from at least the second end 202 of the locking shaft 178. For example, according to the depicted embodiment, the cam shaft 282 and locking aperture 284 may have mating square or rectangular cross-sectional shapes, among other shapes.

The slider body 254 is structured for axial displacement such that a portion of the slider body 254 can be slidingly displaced in the second housing aperture 258 and/or relative to at least the second housing 248. Moreover, during operation, the slider arm 256 can be selectively engaged and disengaged from the retention slot 246 of the second chassis spindle 142. Accordingly, when in a disengaged first position, the slider body 254 may be axially positioned such that the slider body 254, and more specifically the slider arm 256, does not extend into the retention slot 246 of the second chassis spindle 142. In such a situation, the second chassis spindle 142 can be rotatably displaced without affecting the axial position of the slider body 254. However, when in an engaged second position, at least a portion of the slider body 254, such as the slider arm 256, may extend into the retention slot 246 of the second chassis spindle 142. In such a situation, subsequent rotational displacement of the second chassis spindle 142 may facilitate at least a portion of the second chassis spindle 142 (such as, for example, a portion of an adjacent second extension 244), to engage the slider body 254 (such as, for example, the slider arm 256) in a manner that facilitates axial displacement of the slider body 254 away from the retention slot 246.

Axial displacement of the slider body 254 away from the retention slot 246 can effect an auto-unlock of the latch assembly 112 at least when the latch bolt 152 of the latch assembly 112 is in the extended, locked position. For example, FIG. 6 illustrates the position in which the locking shaft 178 has been moved to the unlocked position by means of the auto-unlock method of unlocking. In certain situations, the locking lug 180 can remain in the locked position, as shown in FIG. 6, while the locking shaft 178 is at the orientation illustrated in FIG. 5, the second lever 134 has also effected retraction of the latch bolt 152, since the first and second levers 118, 134 operate independently. Therefore, in such situations, although a load is still applied to the first lever 118, egress from the inside is readily achieved without significant difficulty, and internal locking components (such as, for example, components of the locking module 126 and/or latch assembly 112) are generally protected against damaging forces.

According to the depicted embodiment, the slider body 254 includes the body portion 268, the slider arm 256, at least one guide 286*a*, 286*b* and a slider shaft 288. As previously discussed, the slider arm 256 is structured for selectable axial placement into, and from, the retention slot 246. According to the illustrated embodiment, the slider arm 256 includes a pair of angled or tapered walls 290*a*, 290*b* on opposing sides of the slider arm 256 that can mate corresponding angled or tapered walls 292*a*, 292*b* on opposing sides of the retention slot 246 and/or adjacent second extensions 244. Such angled or tapered walls 290*a*, 290*b* may assist in the axial displacement of the slider arm 256 from the retention slot 246 as the second chassis portion 138 is rotatably displaced in either first or second directions, the second direction being in a direction that is opposite of the first direction.

According to certain embodiments, when the second chassis spindle 142 is rotatably displaced (such as, for example, via the rotation of the second lever 134 in a first direction), a second extension 244 may be rotatably displaced such that a tapered wall 292*a* of a second extension 244 adjacent to one side of the retention slot 246 engages an adjacent angled or tapered wall 290*a* of the slider arm 256 in a manner that can push or slide against the angled or tapered wall 290*a* of the slider arm 256 such that the slider arm 256 is axially displaced in a direction away from the second chassis spindle 142. Conversely, when the second chassis spindle 142 is rotatably displaced in a second direction, an angled or tapered wall 290*b* of another second extension 244 adjacent to another side of the retention slot 246 engages the adjacent angled or tapered wall 290*b* of the slider arm 256 in a manner that can push or slide against the slider arm 256 in a manner that axially displaces the slider arm 256 in a direction away from the second chassis spindle 142.

Additionally, according to certain embodiments, the slider body 254 is further structured for axial displacement of the slider body 254 relative to the cam body 250 at least as the cam body 250 is the rotatably displaced. According to the depicted embodiment, the cam body 250 includes a cam orifice 294 that is sized to receive slideable insertion of the slider shaft 288, which may assist in at least guiding the axial displacement of the slider body 254 relative to the cam body 250. Additionally, according to certain embodiments, a portion of the body portion 268 may be structured to be positioned within at least one of the one or more helical outer grooves 278 of the cam body 250 while the cam body 250 rotates and the relative axial positions of the slider body 254 and the cam body 250 are adjusted. For example, according to the depicted embodiment, the body portion 268 includes a rear wall 296, a portion of which, according to certain embodiments, is generally perpendicular to the cam axis 270 of the cam body 250, and another portion that includes one or more angled or tapered wall sections 298 that is/are adapted to engage and/or be received within an adjacent wall 299*a*, 299*b* that defines, at least in part, the helical outer groove 278.

Figure 10:
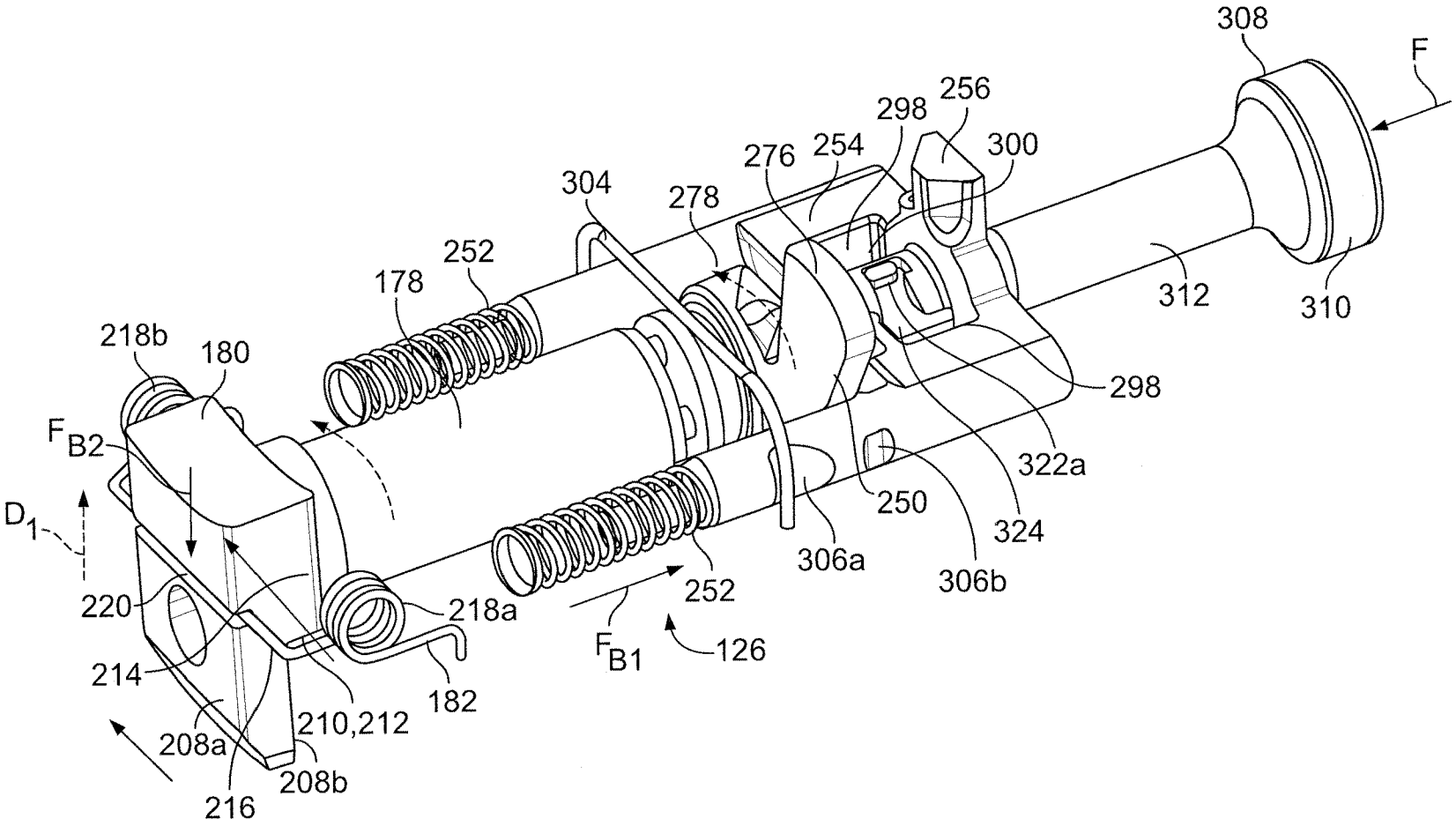
FIG. 10 illustrates a top perspective view of certain components of an exemplary locking module when the locking module is in an unlock position or state and a first, inward external input force is being exerted against the activation interface.
Figure 11:
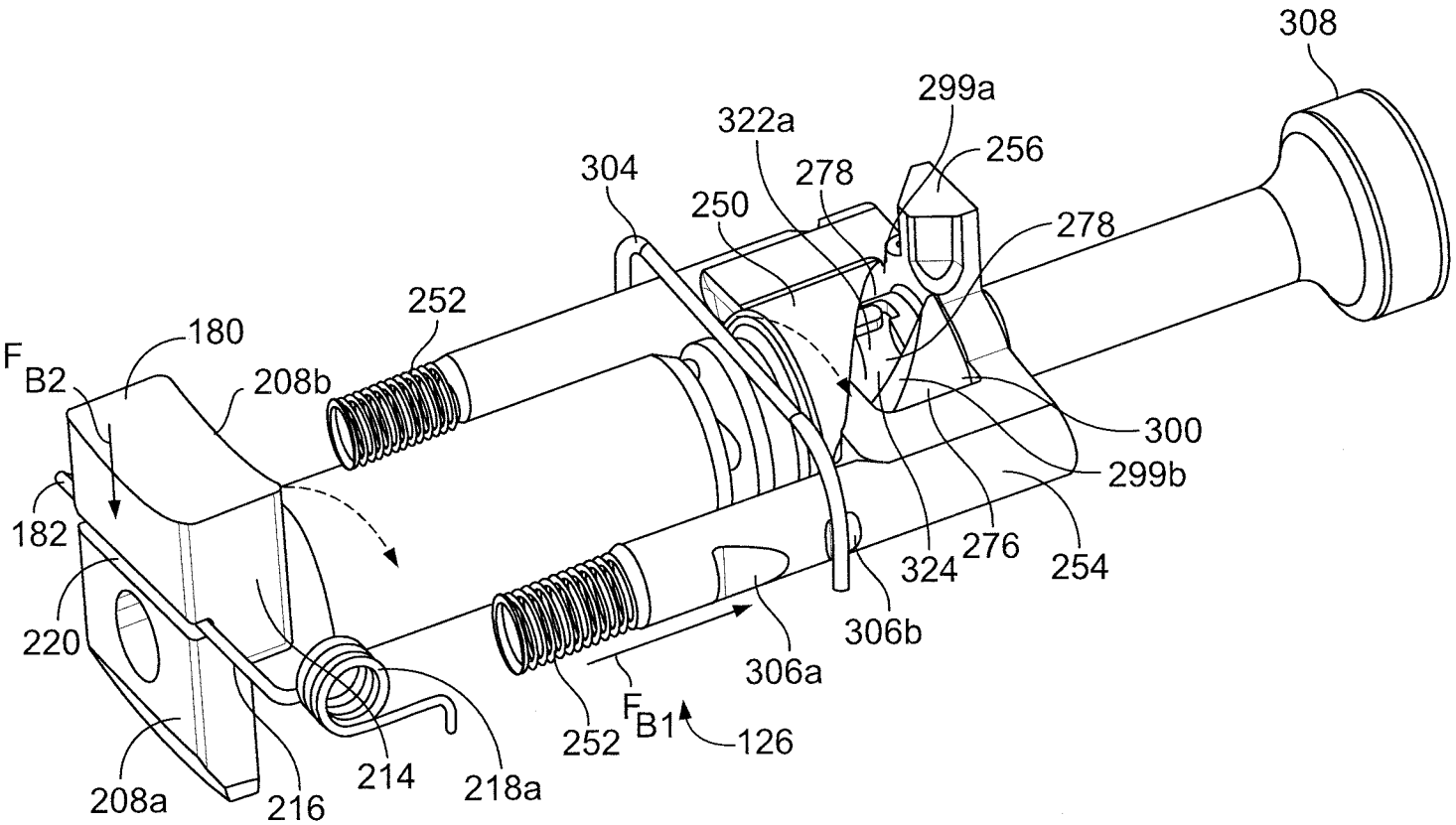
FIG. 11 illustrates the components of the locking module depicted in FIG. 10 in a locked second position with exemplary slider biasing elements and an exemplary lug biasing element being in cocked or compressed positions or states.

According to certain embodiments, as the slider body 254 is axially displaced in a first direction, a first angled or tapered wall section 298 of the rear wall 296 engages (such as, for example, slides or pushes) an adjacent first wall 299*a* of the helical outer groove 278 in a manner that facilitates rotational displacement of the cam body 250 in a first direction, such as, for example, a first rotational direction R1 (FIG. 11). Similarly, when the slider body 254 is axially displaced in a second direction that is opposite of the first direction, a second angled or tapered wall section 298 engages an second wall 299*b* of the helical outer groove 278, the first and second walls 299*a*, 299*b* being on opposing sides of the helical outer groove 278. Further, the first and second angled or tapered wall sections 298 of the rear wall 296 may be tapered or angled in opposite directions. Moreover, the second angled or tapered wall 298 can be oriented to exert a force that slides or pushes the second wall 299*b* of the helical outer groove 278 in a manner that facilitates rotational displacement of the cam body 250 in a second direction, such as, for example a second rotational direction R2 (FIG. 10). Further, according to the depicted embodiment, the slider body 254 may also include an opening 300 adjacent to the rear wall 296 that is adapted to receive removable rotable placement, and/or withdrawal, of at least a portion of the cam hub 276 of the cam body 250 as the cam body 250 rotates and the relative axial positions of the cam body 250 and the slider body 254 is adjusted.

According to the depicted embodiment, the at least one guide 286*a*, 286*b* comprises two guides, each guide 286*a*, 286*b* being generally parallel to the slider shaft 288 and structured to be coupled to one of the at least one slider biasing elements 252. Moreover, according to the illustrated embodiment, the guides 286*a*, 286*b* can be configured to include a shoulder portion 302 against which the adjacent slider biasing element 252 may exert a force that may bias the slider body 254 toward a unlocked first position in which the slider arm 256 minimally extends, if at all, into the retention slot 246. According to certain embodiments, one end of each slider biasing element 252 may abut against the shoulder portion 302 of the adjacent guide 286*a*, 286*b*, and the other end of the slider biasing elements 252 abuts against the second housing 248.

According to certain embodiments, the slider biasing elements 252 can be structured and/or positioned to at least provide additional assistance in generally biasing the slider body 254 to the disengaged first position. Additionally, the slider biasing elements 252 can be structured to at least assist in accelerating at least the second locking module portion 140, as well as other components of the second locking module portion 140 and/or the lock assembly 100, to the unlocked position in a manner that may produce an audible cue that can be generated by impact deceleration of certain components of the lock assembly 100.

Optionally, according to other embodiments, the slider biasing elements 252 may be omitted. For example, in the absence of slider biasing elements 252, the interaction of at least some, if not all, of the tapered walls 290*a*, 290*b*, 292*a*, 292*b* and rotation of the chassis spindle 142 can effect translation of slider body 254 from an engaged second position to a disengaged first position. Additionally, in the absence of external input forces to the system (such as, for example, the inward external input force ($F_{input}$) discussed below with reference to FIG. 10), the detent spring 304 and scallops 306*a*, 306*b* may be designed such that slider body 254 can be biased to either of the first and second positions, were the slider body to be slightly shifted from either of these positions.

Additionally, according to certain embodiments, biasing elements, (such as, for example, springs) can be structured and/or positioned to provide an over-center toggle type biasing that resists displacement of at least the slider body 254 from the current locked or unlocked position of the slider body. For example, according to certain embodiments that do not include the slider biasing elements 252, other biasing elements can be arranged to, when the slider body 254 is at the locked position, provide a force(s) that resists the displacement of the slider body 254, among other components of the lock assembly 100, from the locked position. Further, according to such an embodiment, the over-center toggle type biasing of biasing elements can, when the slider body 254 is at the unlocked position, provide a force that resists the displacement of the slider body 254, among other components of the lock assembly 100, from the unlocked position.

Referencing FIG. 10, the guides 286*a*, 286*b* may also be structured to engage a detent spring 304 that is adapted to, in the absence of an external force that can overcome the force of the detent spring 304, hold at least the slider body 254 in either a locked or unlocked position. According to the illustrated embodiment, each of the guides 286*a*, 286*b* can include a plurality of detent scallops 306*a*, 306*b*. For example, the guides 286*a*, 286*b* may each have a first detent scallop 306*a* that is positioned to engage the detent spring 304 in a manner that retains at least the slider body 254 in an unlocked position. The guides 286*a*, 286*b* may each also have a second detent scallop 306*b* that is positioned to engage the detent spring 304 in a manner that retains at least the slider body 254 in a locked position.

As shown in at least FIGS. 1, 10 and 11, in addition to the first and second locking module portions 124, 140 the locking module 126 may further include an activation interface 308, such as, for example, a push button interface, among other types of interfaces. The activation interface 308 may be operably coupled to the slider body 254 such that operable engagement of the activation interface 308 may be translated to the slider body 254 in a manner in which the slider body 254 can serve as a motion input for the second locking module portion 140. As shown by at least FIGS. 12 and 13, according to the depicted embodiment, the activation interface 308 includes an outer body 310 and an inner body 312, at least a portion of the inner body 312 extending into an orifice 314 in the second rose 136. However, according to other embodiments, rather than having separate inner and outer bodies 310, 312, the activation interface 308 may have a single, monolithic construction. Additionally, according to certain embodiments, the activation interface 308 can be an integral portion of the slider body 254, or can be a separate component that is coupled to the slide body 254, such as, for example, by a mechanical fastener or adhesive, among other manners of connection.

In the illustrated embodiment, the activation interface 308 is installed, which enables the lock assembly 100 to provide a privacy or locking functionality as described herein. In certain forms, the activation interface 308 may be removable, and such removal may cause the lock assembly 100 to provide passage functionality. Further details regarding exemplary features that enable such conversion of the lock assembly 100 between privacy and passage functionalities are provided in U.S. Provisional Patent Application No. 62/311,996 filed Mar. 23, 2016, the entire contents of which are incorporated herein by reference.

According to the depicted embodiment, a portion of the outer body 310 may slideably extend through an orifice 314 in the second rose 136 such that at least a portion of an activation body 316 at a second end 318*b* of the outer body 310 may be engaged by a user of the lock assembly 100 when the lock assembly 100 is operably mounted or coupled to an entryway device 102. The activation body 316 may have a variety of different shapes and sizes. Further, the activation body 316 may be sized and/or shaped such that at least a portion of the activation body 316 may be operably engaged by a user (such as, for example, pressed for axial and/or rotatable displacement), as well configured to provide, and/or not interfere with other, aesthetic features. For example, according to the depicted embodiment, the activation body 316 may have a generally cylindrical or button shape in which an outer surface of the activation body 316 may be depressed toward the second rose 136. Further, according to certain embodiments, the activation body 316 may be shaped so as to assist in a user in pulling at least the activation body 316 away from the second rose 136.

The activation interface 308 may be structured to be engaged with an inner segment 324 that may be or may not be an integral portion of the activation interface 308. The inner segment 324 may include one or more shoulders 320 that can be engaged by the first end 318*a* of the outer body 310. According to such an embodiment, the first end 318*a* of the activation interface 308 may, when inwardly axially displaced, exert a force against the shoulder(s) 320 of the inner segment 324 that causes axial displacement of the inner segment 324 in a similar direction. Additionally, according to the depicted embodiment, as shown in at least FIGS. 10 and 11, one or more protrusions 322 can outwardly extend from the inner segment 324 and into the opening 300 in the body portion 268. According the illustrated embodiment, the inner segment 324 includes two protrusions 322 on opposing sides of the inner segment 324 that extend in a direction that is generally perpendicular to a central activation axis 327 (FIG. 12) of the activation interface 308. Further, the protrusions 322 are each structured such that, at least during assembly, the inner segment 324 can be rotated into a groove or slot in the opening 300 of the slider body 254 so that the protrusions 322 can be positioned at a location to transmit the axial force of the activation interface 308 to the slider body 254

FIGS. 10 and 11 provide an example of operation of components of the locking module 126, with forces that are acting on the locking module 126 being depicted by solid arrowed lines, and the resultant motion of components being depicted by dashed arrowed lines. FIG. 10 illustrates a top perspective view of certain components of the locking module 126 when the locking module 126 is in an unlock state and a first, inward external input force ($F_{input}$) is being exerted against the activation interface 308. The first, inward external input force ($F_{input}$), and associated axial displacement of the slider body 254 can initiate linear translation of the slider body 254. Further, as discussed above, such linear displacement of the slider body 254 is, via interaction between the slider body 254 and the helical outer groove(s) 278 of the cam body 250, converted to rotary motion of the cam body 250.

The cam body 250 can be engaged with the locking shaft 178 via an interface that can accommodate torque transmission from the cam body 250 to the locking shaft 178. For example, as previously discussed, cam shaft 282 (FIGS. 9, 12 and 13) can have a non-round cross-sectional shape that telescopes into a mating non-round locking aperture 284 in the locking shaft 178. Thus, the rotary motion of the cam shaft 282 can be transferred to the locking shaft 178. The locking shaft 178 also includes features (such as, for example, the previously discussed cam protrusion 204) that convert the rotary motion of the locking shaft 178 to linear translation of the locking lug 180. The locking lug 180 can, therefore, be driven into engagement with the first chassis spindle 128, such as, for example, by insertion of the locking lug 180 into the locking slot 174 of the first chassis spindle 128.

Additionally, displacement of components of the locking module 126 may have to overcome at least certain biasing forces. For example, the axial displacement of the slider body 254 as the slider body 254 is displaced from the unlocked first position to the locked second position can cause deflection of the slider biasing elements 252, which, according to the depicted embodiment, can be springs. According to such an embodiment, such deflection of the slider biasing elements 252 can increase the biasing force ($F_{B1}$ in FIG. 10) being applied by slider biasing elements 252 to the slider body 254. Similarly, axial displacement of the locking lug 180 in a first direction ($D_1$ in FIG. 10) can cause deflection of the lug biasing element 182, which can increase the biasing force applied from the lug biasing element 182 to the locking lug 180. Additionally, as indicated by a comparison of FIGS. 10 and 11, displacement of the slider body 254 may result in the detent spring 304 being transitioned out of engagement with a first scallop 306*a* of the guides 286*a*, 286*b* to placement in a second scallop 306*b*. Alternatively, according to other embodiments, rather than using the lug biasing element 182, the locking lug 180 can be displaced to the disengaged position by a gravitational force. Correspondingly, a tapered wall section 298 of the slider body 254 can engage the second wall 299*b* of the helical groove 278 so as to effectuate rotation of the cam shaft 282 in the second, opposite rotational direction. Thus, by the telescoping engagement between cam shaft 282 and the locking shaft 178, the locking shaft 178 can also be rotated back to the first position such that the cam protrusion 204 does not impede the linear motion of the locking lug 180.

Thus, according to certain embodiments, displacement of the locking module 126 from the unlocked first position to the locked second position can involve the application of a first, inward external input force ($F_{input}$) that overcomes internal biasing forces of at least the slider biasing elements 252, the lug biasing element 182, and the detent spring 304, as well as friction associated with the linear and/or rotational displacement of components of the locking module 126. The magnitude of the first, inward external input force ($F_{input}$) used to overcome such forces and friction can be adjusted by selection of the slider biasing elements 252 and the lug biasing element 182, and moreover the biasing forces ($F_{B1}$, $F_{B2}$) associated with those components and component interface friction coefficients. Further, the holding performance of the detent spring 304 in the first and second scallops 306*a*, 306*b* can be adjusted by selection of a spring wire size of the detent spring 304 and/or by adjusting certain geometries of components of the locking module 126, such as, for example, the depth of the first and/or second scallop 306*a*, 306*b*.

Referring to FIG. 11, the process of releasing the locking module 126 from the locked second position to the unlocked first position includes releasing the slider biasing elements 252 and the lug biasing element 182 from the cocked or compressed state. In the absence of a second, outwardly external force, the slider biasing elements 252 and the lug biasing element 182 can remain in such a cocked state. Further, release of the locking module 126 from the locked second position to the unlocked first position application can involve the application of a second, outwardly external force that can overcome a holding force provided by the engagement between the detent spring 304 and the second scallop 306*b* of the guides 286*a*, 286*b*. Once that holding force has been exceeded, the biasing forces ($F_{B1}$, $F_{B2}$) of the slider biasing elements 252 and the lug biasing element 182 can return the locking module 126 to the unlocked first position. Compared to FIG. 10, the rotational ($R_1$, $R_2$) and linear displacement motions involved in the return of the locking module 126 to the unlocked second position, can be in a direction that is opposite to the direction those components moved when the locking module 126 was displaced to the locked first position. Further, such opposite or reverse movement of those components may continue until such motions are arrested by the physical constraints of the various components, including, but not limited to, housing components of the locking module 126 or lock assembly 100.

FIG. 12 illustrates a cross sectional view of the exemplary lock assembly 100 in an unlocked position or state, and includes an exemplary example of geometrical clearances that can be present between the first and second chassis spindles 128, 142 and the first and second locking module portions 124, 140. Such clearances may accommodate relatively free rotation of the first and second chassis spindles 128, 142 when the lock assembly 100 is in the unlocked position or state. From a position adjacent to the first side 108*a* of the entryway device 102, rotation of first lever 118 can impart rotation to first chassis spindle 128 and the first drive spindle 132, thereby enabling rotation of a first latch cam 326 to effect retraction of the latch bolt 152 of the latch assembly 112. From a position adjacent to the second side 108*b* of the entryway device 102, rotation of the second lever 134 can impart rotation to second chassis spindle 142 and second drive spindle 150, thereby enabling rotation of a second latch cam 328 to effect retraction of the latch bolt 152 of the latch assembly 112. Accordingly, from such an arrangement, the first and second levers 118, 134 can operate independently of each other.

FIG. 12 also depicts the telescoping arrangement of cam shaft 282 and the locking shaft 178. According to such an embodiment, if the spatial separation between the first and second chassis portions 122, 138 were to increase as a result of an increase in the thickness of the entryway device 102, the cam shaft 282 and the locking shaft 178 would remain telescopically engaged and coupled for concurrent rotation. Such an arrangement can allow the locking module 126 generally to operate consistently, with relative insensitivity to the thickness of the entryway device 102.

FIG. 13 illustrates a cross-sectional view of the exemplary lock assembly 100 in the locked position or state. In this state, the locking lug 180 is engaged with the locking slot 174 of the first chassis spindle 128 in a manner that prevents rotational displacement of the first lever 118, and thereby prevents the latch bolt 152 from being retracted by way of the first latch cam 326. FIG. 13 also depicts the slider body 254, and more particularly the slider arm 256, as engaged with the retention slot 246. In such a situation, rotation of the second chassis spindle 142 via rotation of the second lever 134 may result in an edge or wall 292*a*, 292*b* of the retention slot 246 and/or an adjacent second extension 244 engaging the slider body 254, such as, for example, engaging the slider arm 256 in a manner that imparts an input force on the slider body 254 that displaces the slider body 254 toward the unlocked first position. Additionally, rotation of the second lever 134 may relatively simultaneously affect unlocking of the locking module 126 and retraction of the latch bolt 152 of the latch assembly 112. Thus, rotation of the second lever 134 can provide auto-unlock functionality, which may be a primary method of unlocking the locking module 126.

Additionally, according to certain embodiments, the locking module 126 may be unlocked in manners other than the above-discussed auto-unlocking functionality. For example, according to certain embodiments, an additional manner of unlocking the locking module 126 can be attained by applying a pulling force on the activation interface 308, which can be translated into at least displacement of the slider arm 256 out from the retention slot 246. Another manner of unlocking the locking module 126, according to certain embodiments, can be applying a pushing force on the end of the slider shaft 288. For example, an instrument can be inserted through a hole of the second chassis portion 138, through an opening 330 in the locking lug 180, and though a hole in the locking shaft 178 such that the instrument can apply an axial force against the slider shaft 288 such that the slider body 254 is axially displaced to the disengaged first position. Moreover, such displacement of the slider body 254 via the force of the instrument against the slider body 254 can facilitate the release or removal of the slider arm 256 from the retention slot 246, thereby effectively unlocking the locking module 126. Such unlocking of the lock module 126 can be referred to as emergency unlock functionality. Correspondingly, the tapered wall section 298 of the slider body engages second wall 299*b* of helical groove 278, effecting rotation of the cam shaft 282 in the second, opposite rotational direction. Thus, by the telescoping engagement between cam shaft and locking shaft, the locking shaft is also rotated back to the first position such that the cam protrusion no longer impedes the linear motion of the locking lug.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law.

Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An apparatus for a lock device, comprising:

a first locking module having a locking shaft and a locking lug, the locking shaft having a first end, a second end, and a cam protrusion, the cam protrusion outwardly extending at the first end of the locking shaft; and a second locking module having a cam body and a slider body, the cam body including a helical groove having a first wall and a second, opposing wall;

wherein at least a portion of the slider body slidingly engages the first wall of the helical groove as the slider body is linearly displaced from a first position to a second position to rotate the cam body in a first rotational direction and effectuate rotational displacement of the cam protrusion in the first rotational direction, the cam protrusion linearly displacing the locking lug in a first direction to a locked position as the cam protrusion rotates in the first rotational direction; and wherein at least a portion of the slider body slidingly engages the second wall of the helical groove as the slider body is linearly displaced from the second position to the first position to rotate the cam body in a second rotational direction and effectuate rotational displacement of the cam protrusion in the second rotational direction, the locking lug being displaceable in a second direction to an unlocked position as the cam protrusion rotates in the second rotational direction, the second rotational direction being opposite of the first rotational direction and the second direction being opposite of the first direction.

2. The apparatus of claim 1, wherein the locking shaft includes an aperture that extends through at least the second end of the locking shaft, and wherein the cam body includes a cam shaft sized for a mating engagement in the aperture to effectuate the transmission of rotational displacement from the cam shaft to the locking shaft.

3. The apparatus of claim 2, wherein the cam shaft and the aperture of the locking shaft each have a non-circular cross-sectional shape.

4. The apparatus of claim 1, wherein the second locking module includes at least one slider biasing element positioned against the slider body and exerting a biasing force to bias the slider body toward the second position.

5. The apparatus of claim 1, wherein the first locking module includes a lug biasing element positioned against the locking lug and exerting a biasing force to bias the locking lug in the second direction.

6. The apparatus of claim 5, wherein the locking lug includes an opening sized for insertion of an instrument through the opening of the locking lug, the first end of the locking shaft also having an opening sized to receive insertion of the instrument, and wherein, when the locking lug is in the locked position, the instrument passes through the openings of the locking lug and the locking and exerts a force against the slider body that linearly displaces the slider body toward the second position.

7. The apparatus of claim 6, wherein the locking lug is sized to extend into a locking slot of a first chassis spindle of a lock assembly when at the locked position, the locking lug further sized to prevent rotation of the first chassis spindle when positioned in the locking slot, and wherein, when at the unlocked position, the locking lug is sized to not impede rotation of the first chassis spindle.

8. The apparatus of claim 7, wherein the slider body includes a slider arm, at least a portion of the slider arm sized to extend into a retention slot of a second chassis spindle of the lock assembly when the slider body is at the second position, the slider arm shaped for linear displacement away from the retention slot upon rotational displacement of the second chassis spindle, and wherein the locking shaft is rotatably displaced in the second rotational direction when the slider arm is linearly displaced away from the retention slot.

9. The apparatus of claim 8, wherein the second locking module further includes a detent spring, and wherein the slider body includes at least a first scallop and at least a second scallop, the first scallop sized to retain the detent spring in a first position, the second scallop sized to retain the detent spring in a second position, the detent spring exerting a biasing force to retain the slider body in the first position when the detent spring securely engages one of the first and second scallops, and the detent spring exerting a biasing force to retain the slider body in the second position when the detent spring securely engages the other of the first and second scallops.

10. The apparatus of claim 9, further including an activation interface sized to translate an external force exerted against the activation interface to the slider body, the translated external force effectuating linear displacement of at least the slider body from the first position to the second position.

11. The apparatus of claim 10, wherein the first locking module includes a first housing having a first aperture and a lug aperture, the first aperture sized to accommodate rotational displacement of the locking shaft, the lug aperture sized to guide linear displacement of the locking lug in the first and second directions.

12. The apparatus of claim 11, wherein the second locking module includes a second housing having a second aperture sized to accommodate displacement of cam body.

13. The apparatus of claim 12, wherein the slider body includes a slider shaft sized for linear displacement within a cam aperture of the cam body.

14. The apparatus of claim 13, wherein the linear displacement of the slider body between the first and second positions are in directions that are generally perpendicular to the first and second directions.

15. A lock assembly, comprising:

a first latch assembly portion having a first lever, a first chassis portion, and a first locking module portion, the first locking module portion having a locking shaft and a locking lug, the locking shaft having a cam protrusion, the first chassis portion including a locking slot sized to receive selective insertion of at least a portion of the locking lug; and a second latch assembly portion having a second lever, a second chassis portion, and a second locking module portion, the second locking module portion having a cam body and a slider body, the slider body having a slider arm, the second chassis portion including a retention slot sized to receive selective insertion of at least a portion of the slider arm;

wherein linear displacement of the slider body from an unlocked position to a locked position of the slider body is translated into rotational displacement of the cam body in a first rotational direction to effectuate rotational displacement of the cam protrusion in the first rotational direction, the rotational displacement of the cam protrusion in the first rotational direction linearly displacing the locking lug in a direction that is perpendicular to a rotational axis of the locking shaft from an unlocked position of the locking lug to a locked position of the locking lug, at least a portion of the locking lug extending into the locking slot of the first chassis portion when at the locked position of the locking lug, the locking lug sized to prevent rotational displacement of the first chassis portion when at the locked position of the locking lug, at least a portion of the slider arm of the slider body extending into the retention slot in the second chassis portion when the slider body is at the locked position of the slider body; and wherein the cam body is rotatably displaceable in a second rotational direction to effectuate rotational displacement of the cam protrusion in the second rotational direction when the slider body is linearly displaced from the locked position of the slider body to the unlocked position of the slider body, the cam protrusion being disengaged from retaining the locking lug in the locked position of the locking lug by displacement of the cam body in the second rotational direction.

16. The lock assembly of claim 15, wherein the first locking module portion includes a lug biasing element positioned against the locking lug and exerting a biasing force to bias the locking lug toward the unlocked position of the locking lug.

17. The lock assembly of claim 15, wherein the second locking module portion includes at least one slider biasing element positioned against the slider body and exerting a biasing force to bias the slider body toward the unlocked position of the slider body.

18. The lock assembly of claim 15, wherein the second locking module portion further includes a detent spring, and wherein the slider body includes at least a first scallop and at least a second scallop, the first scallop sized to retain the detent spring in a first position, the second scallop sized to retain the detent spring in a second position, the detent spring exerting a biasing force to retain the slider body in the locked position of the slider body when the detent spring securely engages one of the first and second scallops, and the detent spring exerting a biasing force to retain the slider body in the unlocked position of the slider body when the detent spring securely engages the other of the first and second scallops.

19. The lock assembly of claim 15, further including an activation interface sized to translate an external force exerted against the activation interface to the slider body, the external force effectuating linearly displacement of at least the slider body from the unlocked position of the slider body to the locked position of the slider body, at least a portion of the activation interface sized for axial displacement in a mating orifice of a second rose of the second latch assembly portion, the second rose size to conceal at least a portion of the second chassis portion in a hole in an entryway device.

20. The lock assembly of claim 19, wherein the locking lug includes an opening sized for insertion of an instrument through the opening of the locking lug, the first end of the locking shaft also having an opening sized to receive insertion of the instrument, wherein, when the instrument extends through the openings of the locking lug and the locking shaft, the instrument engages the slider body and transmits a force against the slider arm that linearly displaces the slider body in a direction toward the locked position of the slider body.

21. The lock assembly of claim 20, wherein the first and second latch assembly portions are coupled to a latch assembly having a latch bolt, rotatable displacement of the first and second chassis portions displacing the latch bolt from an extended position to a retracted position, and wherein the first latch assembly portion includes a first rose, the first rose size to conceal at least a portion of the first chassis portion in a hole in an entryway device.

* * * * *